US011243036B2

(12) United States Patent
Fellows et al.

(10) Patent No.: US 11,243,036 B2
(45) **Date of Patent: *Feb. 8, 2022**

(54) TRIGGER GROUP FOR SEMI-AUTOMATIC FIREARMS

(71) Applicant: Franklin Armory Holdings, Inc., Minden, NV (US)

(72) Inventors: Ryan Paul Fellows, San Jose, CA (US); Jay Leonard Jacobson, Minden, NV (US)

(73) Assignee: FRANKLIN ARMORY HOLDINGS, INC., Minden, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/599,610

(22) Filed: Oct. 11, 2019

(65) Prior Publication Data

US 2020/0049440 A1 Feb. 13, 2020

Related U.S. Application Data

(63) Continuation of application No. 15/923,859, filed on Mar. 16, 2018, now Pat. No. 10,480,881, which is a (Continued)

(51) Int. Cl.

| | |
|---|---|
| ***F41A 19/24*** | (2006.01) |
| ***F41A 19/45*** | (2006.01) |
| ***F41A 19/10*** | (2006.01) |
| ***F41A 17/74*** | (2006.01) |
| ***F41A 19/06*** | (2006.01) |

(Continued)

(52) U.S. Cl.

CPC ..... *F41A 19/24* (2013.01); *F41A 17/74* (2013.01); *F41A 19/06* (2013.01); *F41A 19/10* (2013.01);

(Continued)

(58) Field of Classification Search

CPC ..... F41A 19/24; F41A 19/06; F41A 19/10; F41A 19/12; F41A 19/45; F41A 19/46; F41A 19/44; F41A 19/02; F41A 17/74

(Continued)

(56) References Cited

U.S. PATENT DOCUMENTS 2,027,950 A 1/1936 Young
2,136,511 A * 11/1938 Jones ..... F41A 19/24 42/69.01

(Continued)

*Primary Examiner* — John Cooper

(74) *Attorney, Agent, or Firm* — Bennet K. Langlotz; Langlotz Patent & Trademark Works, LLC

(57) ABSTRACT

Trigger groups for semi-automatic firearms have a frame, a hammer connected to the frame and movable between a cocked position and a striking position, the hammer being biased toward the striking position, a trigger element connected to the frame and movable by a user between a forward position and a rearward position, a selector connected to the frame and movable between at least a first position and a second position, and a plurality of retention facilities each operable to selectively restrain the hammer in the cocked position, and when the selector is in the second position to enable discharge of the firearm in response to movement of the trigger to the forward position after movement to the rearward position and to enable an additional discharge of the firearm upon release of the trigger to the forward position.

1 Claim, 14 Drawing Sheets

Related U.S. Application Data continuation of application No. 15/339,982, filed on Nov. 1, 2016, now Pat. No. 9,952,013.

(60) Provisional application No. 62/250,337, filed on Nov. 3, 2015.

(51) Int. Cl.
*F41A 19/12* (2006.01)
*F41A 19/46* (2006.01)

(52) U.S. Cl.
CPC ..... *F41A 19/12* (2013.01); *F41A 19/45* (2013.01); *F41A 19/46* (2013.01)

(58) Field of Classification Search
USPC ..... 89/139, 129.01, 129.02, 132, 136, 140; 42/69.03
See application file for complete search history.

(56) References Cited

U.S. PATENT DOCUMENTS

| | | | | |
|---|---|---|---|---|
| 6,125,735 | A * | 10/2000 | Guhring | F41A 19/02 42/69.03 |
| 6,966,138 | B1 * | 11/2005 | Deckard | F41A 19/24 42/69.01 |
| 8,667,881 | B1 * | 3/2014 | Hawbaker | F41A 19/46 89/139 |
| 8,820,211 | B1 * | 9/2014 | Hawbaker | F41A 19/46 89/139 |
| 9,146,066 | B1 * | 9/2015 | Cason | F41A 19/09 |
| 2016/0018176 | A1 * | 1/2016 | Fellows | F41A 19/10 42/69.03 |
| 2017/0122686 | A1 * | 5/2017 | Fellows | F41A 17/74 |

* cited by examiner

TRIGGER GROUP FOR SEMI-AUTOMATIC FIREARMS

CROSS-REFERENCE TO RELATED APPLICATION

This application is a Continuation of U.S. patent application Ser. No. 15/923,859 filed on Mar. 16, 2018, entitled "TRIGGER GROUP FOR SEMI-AUTOMATIC FIREARMS," which is a Continuation of U.S. patent application Ser. No. 15/339,982 filed on Nov. 1, 2016, now issued as U.S. Pat. No. 9,952,013, entitled "TRIGGER GROUP FOR SEMI-AUTOMATIC FIREARMS," which claims the benefit of U.S. Provisional Patent Application No. 62/250,337 filed on Nov. 3, 2015, entitled "BINARY FIRING SYSTEM™ (aka BFS™)," which are hereby incorporated by reference in their entirety for all that is taught and disclosed therein.

FIELD OF THE INVENTION

The present invention relates to firearms, and more particularly to a trigger group for semi-automatic firearms.

BACKGROUND OF THE INVENTION

A trigger group includes all parts of the firearm that initiate the firing of the bullet. Parts include the trigger, which is usually a lever that is tripped by one or more fingers of the firing hand; the sear, which holds the hammer back until the trigger has been pulled; a disconnector, which keeps the hammer in place until the trigger is released and the sear takes over after a cycle of semi-automatic fire has occurred; and several springs throughout the group. The sear may be a separate part or can be a surface incorporated into the trigger. As the trigger is pulled, the sear slips, allowing the hammer to strike the firing pin to discharge a round.

The National Firearms Act, as interpreted by the Bureau of Alcohol, Tobacco, Firearms and Explosives Technology Branch, defines the pull of a trigger as a function, and the release of the trigger as a second function. As a result, a firearm that fires a shot upon the pull of a trigger and fires a second shot upon the release of the trigger may not be a machine gun as defined by the National Firearms Act, 26 U.S.C. 5845(b), and would not be subject to the associated legal restrictions.

An existing approach to a trigger system that fires one round with trigger pull and fires another round with trigger release is disclosed in U.S. Pat. Nos. 8,820,211 and 8,667,881 to Hawbaker. Hawbaker's trigger system provides one mode for normal semi-automatic operation and another mode that fires by pulling the trigger and fires a second round upon trigger release. However, Hawbaker's trigger system suffers from multiple disadvantages. First, Hawbaker requires two selectors with two positions each (a safety selector and a mode selector), with the mode selector being located on the trigger. The selector lever that is attached to the trigger must be manipulated within the trigger guard in order to change the mode of firing from semi-automatic to double fire. This attribute greatly increases the likelihood of an accidental discharge occurring from manipulating the selector lever. Second, once the trigger has been pulled in double fire mode, the user cannot place the firearm in safe mode, and instead must fire a second shot upon trigger release. In addition, Hawbaker's trigger must be pulled fully rearward or released fully forward to operate and utilizes two disconnectors.

Therefore, a need exists for a new and improved trigger group for semi-automatic firearms that places the selector lever outside of the trigger guard and enables the firearm to be placed in safe mode even if the trigger has been pulled in double/binary fire mode. In this regard, the various embodiments of the present invention substantially fulfill at least some of these needs. In this respect, the trigger group for semi-automatic firearms according to the present invention substantially departs from the conventional concepts and designs of the prior art, and in doing so provides an apparatus primarily developed for the purpose of providing a trigger group for semi-automatic firearms that places the selector lever outside of the trigger guard and enables the firearm to be placed in safe mode even if the trigger has been pulled in double/binary fire mode.

SUMMARY OF THE INVENTION

The present invention provides an improved trigger group for semi-automatic firearms, and overcomes the above-mentioned disadvantages and drawbacks of the prior art. As such, the general purpose of the present invention, which will be described subsequently in greater detail, is to provide an improved trigger group for semi-automatic firearms that has all the advantages of the prior art mentioned above.

To attain this, the preferred embodiment of the present invention essentially comprises a frame, a hammer connected to the frame and movable between a cocked position and a striking position, the hammer being biased toward the striking position, a trigger element connected to the frame and movable by a user between a forward position and a rearward position, a selector connected to the frame and movable between at least a first position and a second position, and a plurality of retention facilities each operable to selectively restrain the hammer in the cocked position, and when the selector is in the first position to enable discharge of the firearm in response to movement of the trigger to the rearward position and to maintain the firearm without discharging upon release of the trigger to the forward position, and when the selector is in the second position to enable discharge of the firearm in response to movement of the trigger to the forward position after movement to the rearward position and to enable an additional discharge of the firearm upon release of the trigger to the forward position. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
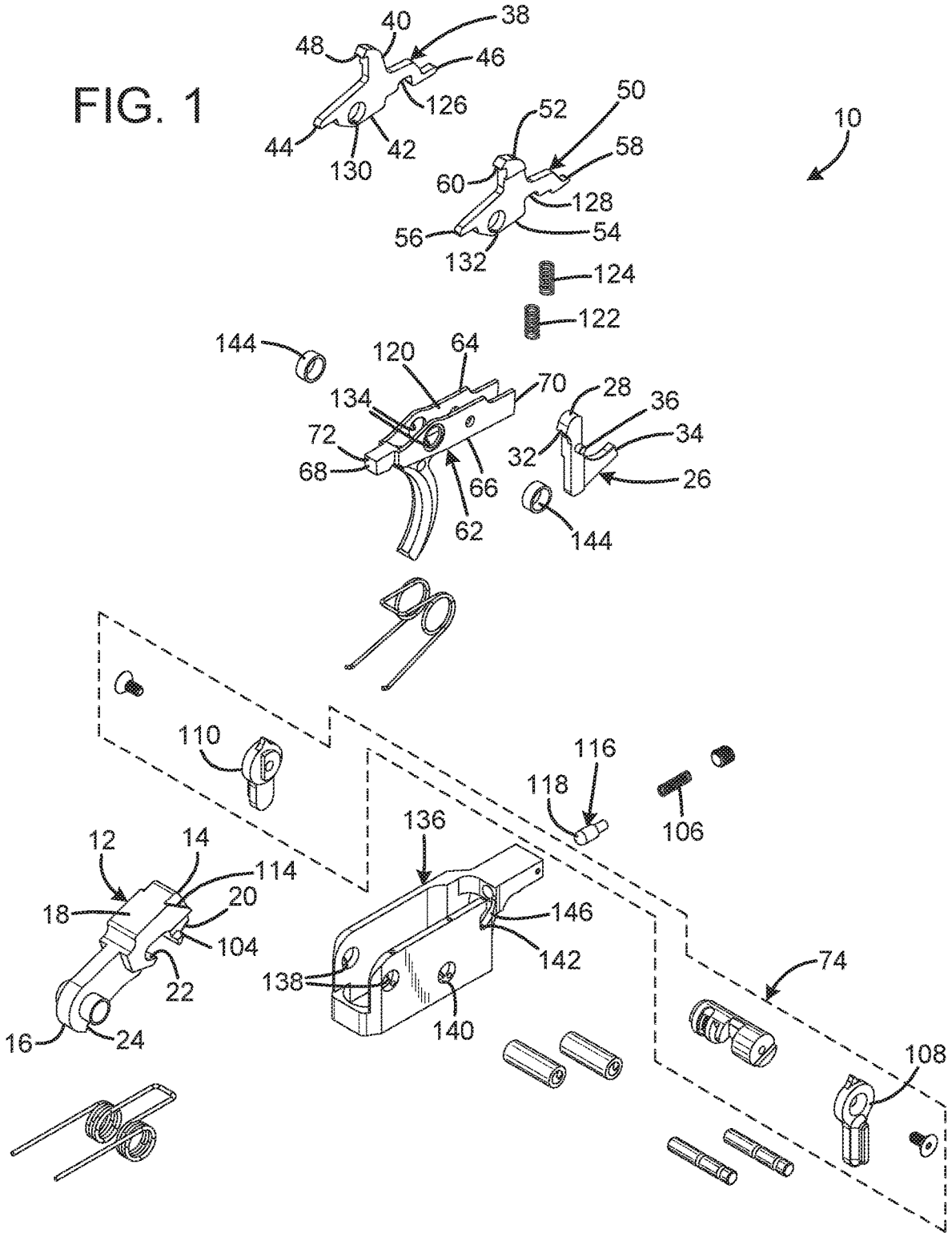
FIG. 1 is an exploded view of the current embodiment of the trigger group for semi-automatic firearms constructed in accordance with the principles of the present invention.

An embodiment of the trigger group for semi-automatic firearms of the present invention is shown and generally designated by the reference numeral 10.

FIG. 1 illustrates the improved trigger group for semi-automatic firearms 10 of the present invention. More particularly, the trigger group for semi-automatic firearms 10 has a hammer 12, backup disconnector 26, binary disconnector 38, semi-automatic disconnector 50, trigger 62, and safety selector assembly 74. When assembled, the hammer, backup disconnector, binary disconnector, semi-automatic disconnector, trigger, and safety selector are connected to a housing 136. Each side of the housing has a front aperture 138, a central aperture 140, and a rear aperture 142. A portion of the housing adjacent to the left rear aperture defines a cam surface 146. The apertures receive cross-pins (unlabeled) that are received within axles (unlabeled), which are cylinders with a thru-hole. The cross-pins hold the trigger group for semi-automatic firearms 10 within the lower of the firearm (not shown). The axles fit through apertures in the hammer, hammer spring (unlabeled), trigger, trigger spring (unlabeled), trigger spacers 144, and the housing. The trigger spacers are on the same level as the trigger, and keep the trigger from sliding laterally within the housing.

The hammer has a top 14, bottom 16, front 18, and rear 20. The top rear of the hammer defines a curved notch 22, and the bottom rear of the hammer defines a hammer sear surface 24. The hammer also includes a leftward protruding ridge 104 directly above the notch 22. A relief area 114 is present above the ridge. The relief area is an optional feature depending upon the thickness of the hammer to provide clearance for the backup disconnector. The backup disconnector has a top 28, bottom 30, front hook 32, and rear 34. The backup disconnector includes a leftward protruding cam pin 36 located below the front hook. The cam pin protrudes through the left rear aperture of the housing and interacts with the cam surface 146. A backup disconnector biasing pin 116 has a tip 118 that is urged forward against the rear of the backup disconnector by a spring 106.

The binary disconnector 38 has a top 40, bottom 42, front 44, rear 46, and central aperture 130. The top of the binary disconnector includes a forward facing hook 48, and the bottom rear defines a notch 126. The semi-automatic disconnector has a top 52, bottom 54, front 56, rear 58, and central aperture 132. The top of the semi-automatic disconnector includes a forward facing hook 60, and the bottom rear defines a notch 128. The trigger 62 has a top 64, bottom 66, front 68, rear 70, and central apertures 134. The top of the front of the trigger includes a sear 72. The binary disconnector 38 and semi-automatic disconnector 50 are each planar elements parallel to and adjacent to each other that fit in a channel 120 along the top spine of the trigger 62. In the current embodiment, the safety selector assembly 74 is ambidextrous, with the lever on the left 108 being larger than the lever on the right 110. The safety selector is swappable, which enables the user to place the larger lever on the desired side of the firearm. The binary disconnector, semi-automatic disconnector, backup disconnector, and sear all act as retention facilities each operable to selectively restrain the hammer in the cocked position. The trigger group for semi-automatic firearms 10 is suitable for use with an AR-15 rifle in the current embodiment.

Figure 2:
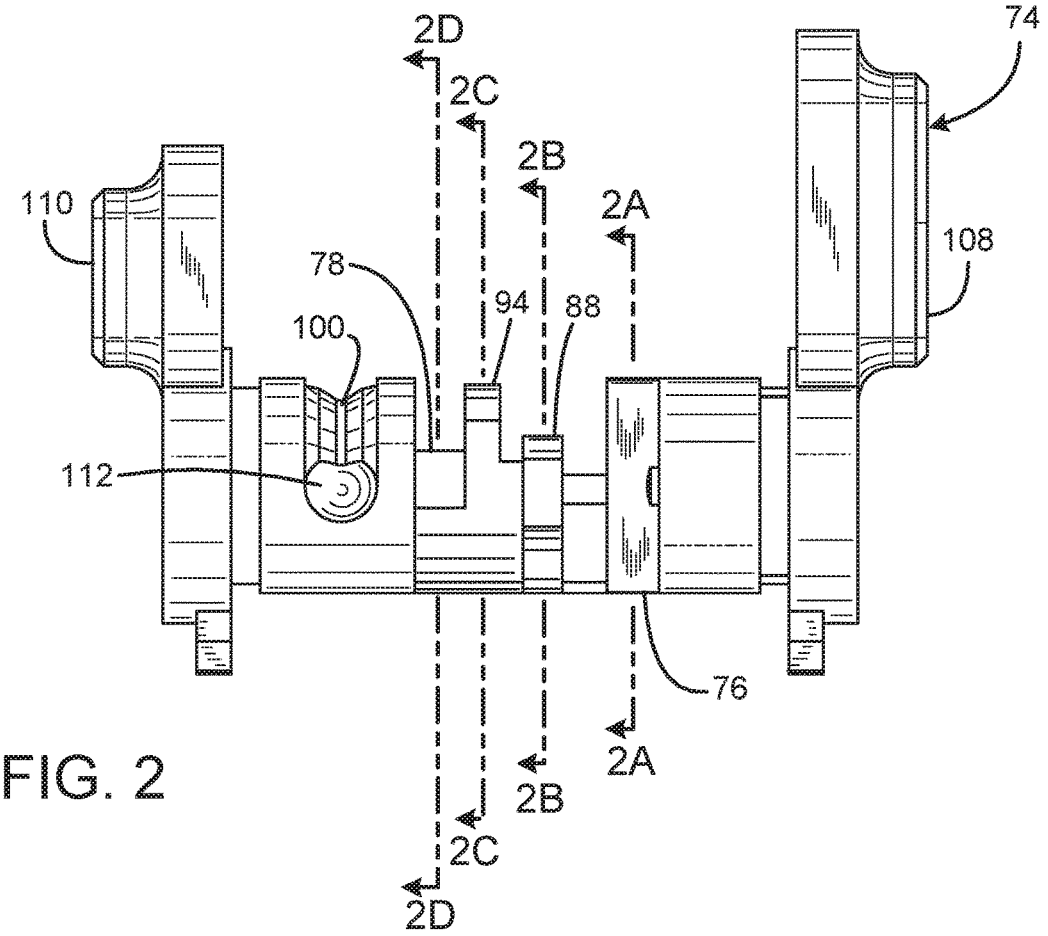
FIG. 2 is a top view of the safety selector of FIG. 1.
Figure 2A:
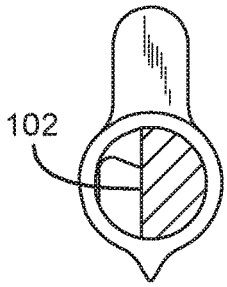
FIG. 2A is a sectional view of the safety selector taken along line 2A-2A of FIG. 2.
Figure 2B:
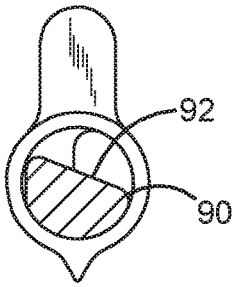
FIG. 2B is a sectional view of the safety selector taken along line 2B-2B of FIG. 2.
Figure 2C:
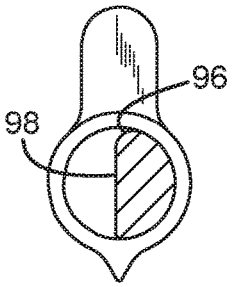
FIG. 2C is a sectional view of the safety selector taken along line 2C-2C of FIG. 2.
Figure 2D:
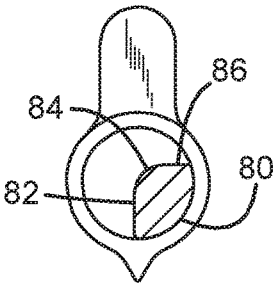
FIG. 2D is a sectional view of the safety selector taken along line 2D-2D of FIG. 2.

FIGS. 2-2D illustrate the improved safety selector assembly 74 of the present invention. More particularly, the safety selector provides the user of an associated firearm with three distinct modes: safe mode, semi-automatic mode, and binary mode. The safety selector has five cam lobe profiles 76, 78, 88, 94, 106 and a safety detent trough 100 extending from left 108 to right 110. Cam lobe 76 regulates the movement of the backup disconnector 26. Cam lobe 78 regulates the movement of the trigger 62. Cam lobe 88 regulates the movement of the semi-automatic disconnector 50. Cam lobe 94 regulates the movement of the binary disconnector 38.

The backup disconnector cam 76 has a section 102 of the cam lobe that engages the protrusion 36 on the backup disconnector 26 to manipulate the backup disconnector. The trigger relief and safety cam 78 has a full diameter section 80 that limits trigger 62 travel to prevent firing in safe mode, a trigger relief cut 82 to enable binary mode firing, a rounded edge 84 to provide a smooth transition between firing modes, and a trigger relief cut 86 to enable semi-automatic firing. The semi-automatic disconnector cam 88 has a cam lobe portion 90 that limits semi-automatic disconnector 50 travel when engaged, and a relief 92 that allows the semi-automatic disconnector to fully articulate. The binary disconnector cam 94 has a cam lobe portion 96 that limits binary disconnector 38 travel when engaged and a relief 98 that allows the binary disconnector to fully articulate.

The safety detent trough 100 located on the far right side 110 of the safety selector is a shallow groove with three plunge cuts 112 spaced 90° apart. A spring-loaded safety detent (not shown) has a tip that travels in this groove and stops at each plunge cut. This feature defines the three separate modes noted above. When additional finger pressure is applied to the safety selector lever, the safety detent spring is overridden, and the safety selector travels to the next plunge cut that defines the next mode.

Figure 3:
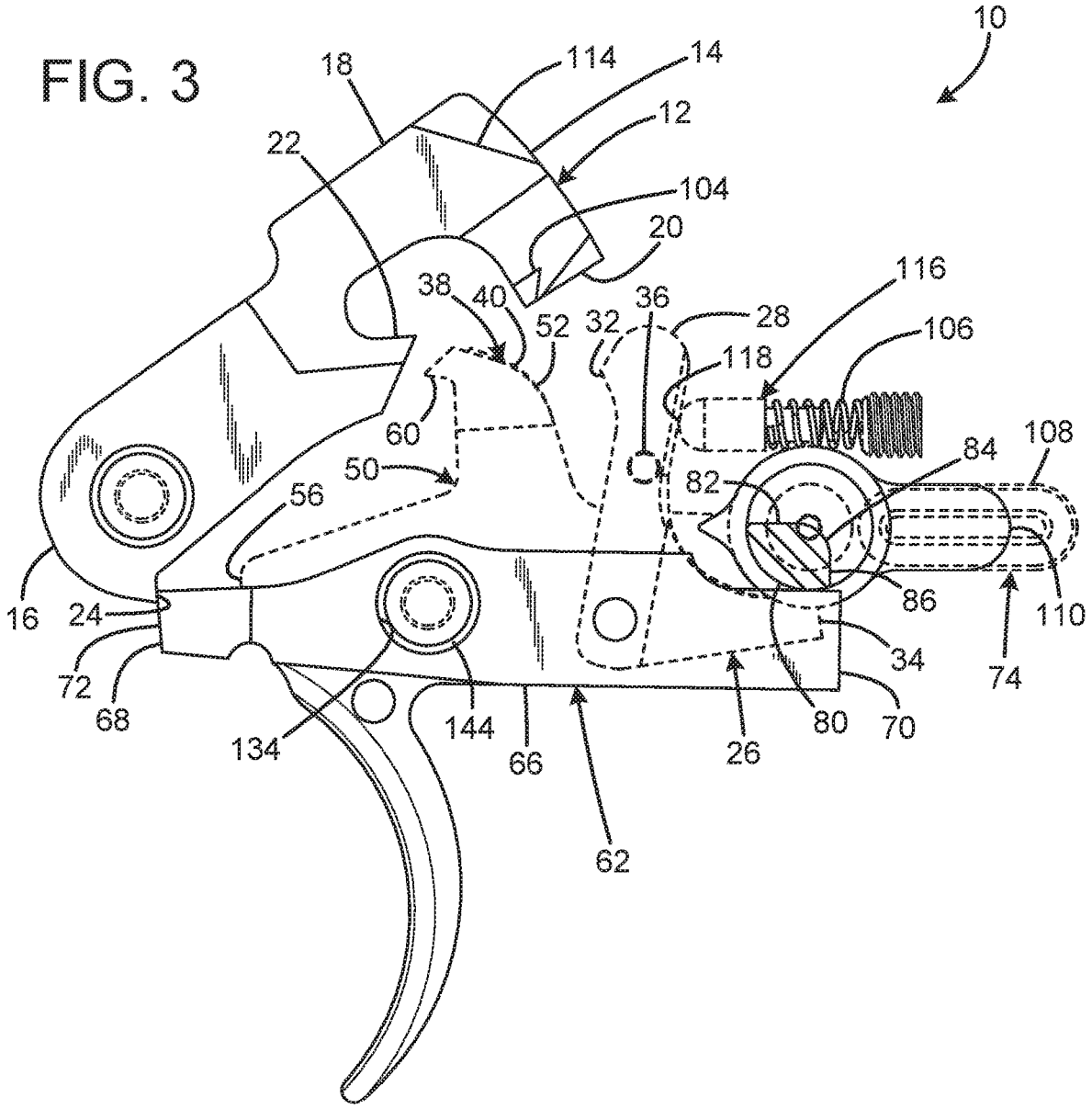
FIG. 3 is a left side sectional view of the trigger group for semi-automatic firearms of FIG. 1 with the safety selector in safe mode and the trigger pulled rearward until stopped by the selector shaft.

FIG. 3 illustrates the improved trigger group for semi-automatic firearms 10 of the present invention. More particularly, the trigger group for semi-automatic firearms 10 is shown in safe mode with the safety selector assembly 74 pointing at the 9 o'clock position. The trigger is physically prevented from being pulled because cam lobe 78 on the safety selector assembly 74 is restricting the rearward section 70 of the trigger from moving upward. Since the trigger is immobilized, the hammer 12 is restricted from rotating forward under spring pressure because the sear 72 on the front 68 edge of the trigger is caught on notch 24 of the hammer. In addition, cam lobe 76 on the safety selector restricts the rear 34 of the backup disconnector 26 from rising.

Figure 4:
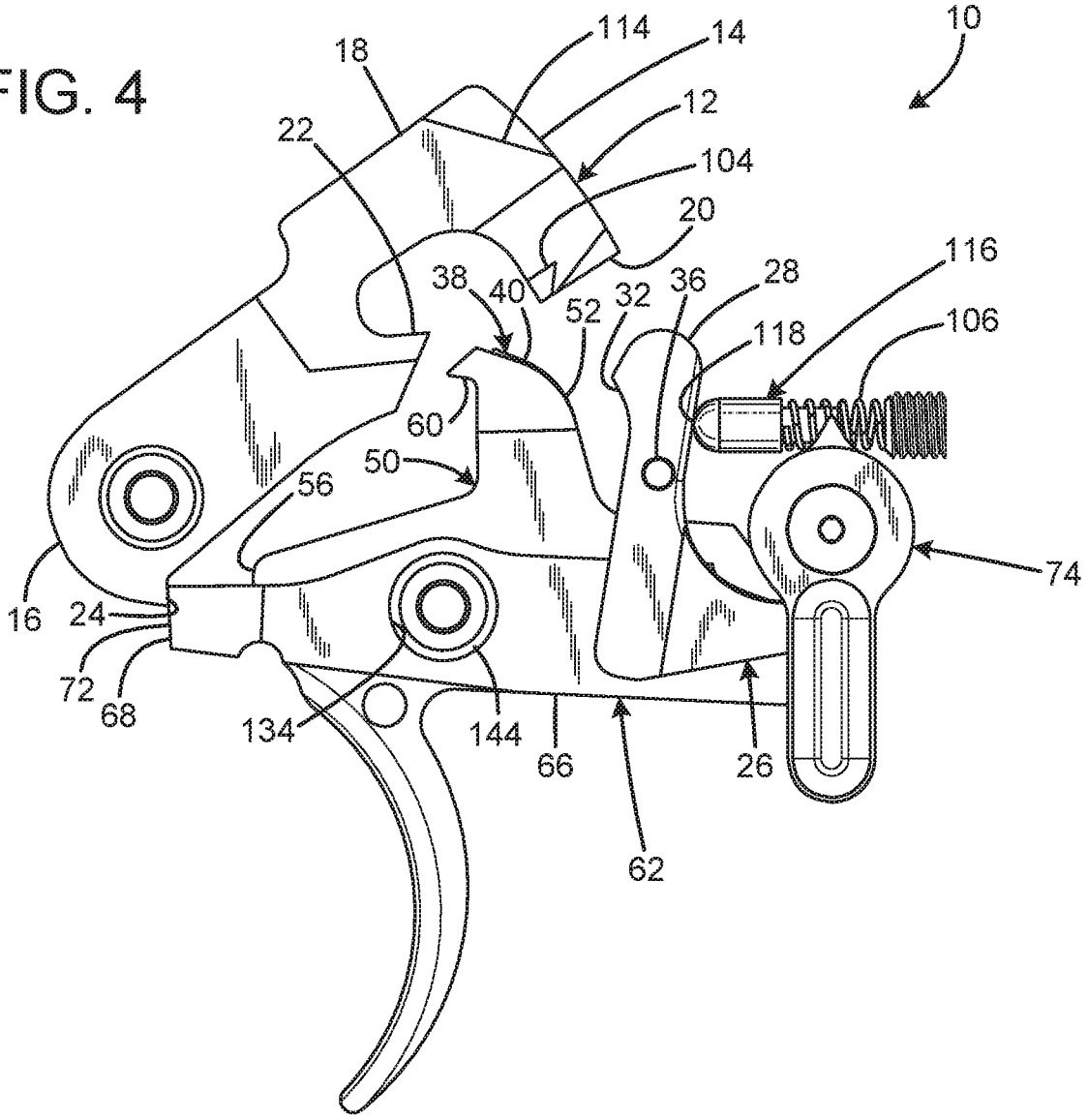
FIG. 4 is a left side view of the trigger group for semi-automatic firearms of FIG. 1 with the safety selector in semi-automatic mode and the trigger at rest.

FIG. 4 illustrates the improved trigger group for semi-automatic firearms 10 of the present invention. More particularly, the trigger group for semi-automatic firearms 10 is shown in semi-automatic mode with the safety selector assembly 74 pointing at the 12 o'clock position. In this mode, cam lobe 78 on the safety selector assembly 74 is recessed to allow the trigger 62 to be pulled when the hammer 12 is cocked. Cam lobe 88 on the safety selector is also recessed to allow the rear 58 of the semi-automatic disconnector 50 to rotate counterclockwise under spring pressure so the hook 60 on the semi-automatic disconnector is able to come into contact with the notch 22 on the hammer. The cam lobe 94 is pushing down on the binary disconnector 38 to prevent the rear 46 from rotating counterclockwise under spring pressure so the hook 48 on the binary disconnector is able to interface with the hammer. Cam lobe 76 on the safety selector restricts the rear 34 of the backup disconnector 26 from rising. If the trigger is pulled in this mode, the hammer will rotate forward under spring pressure and hit the firing pin (not shown) to discharge a round.

Figure 5:
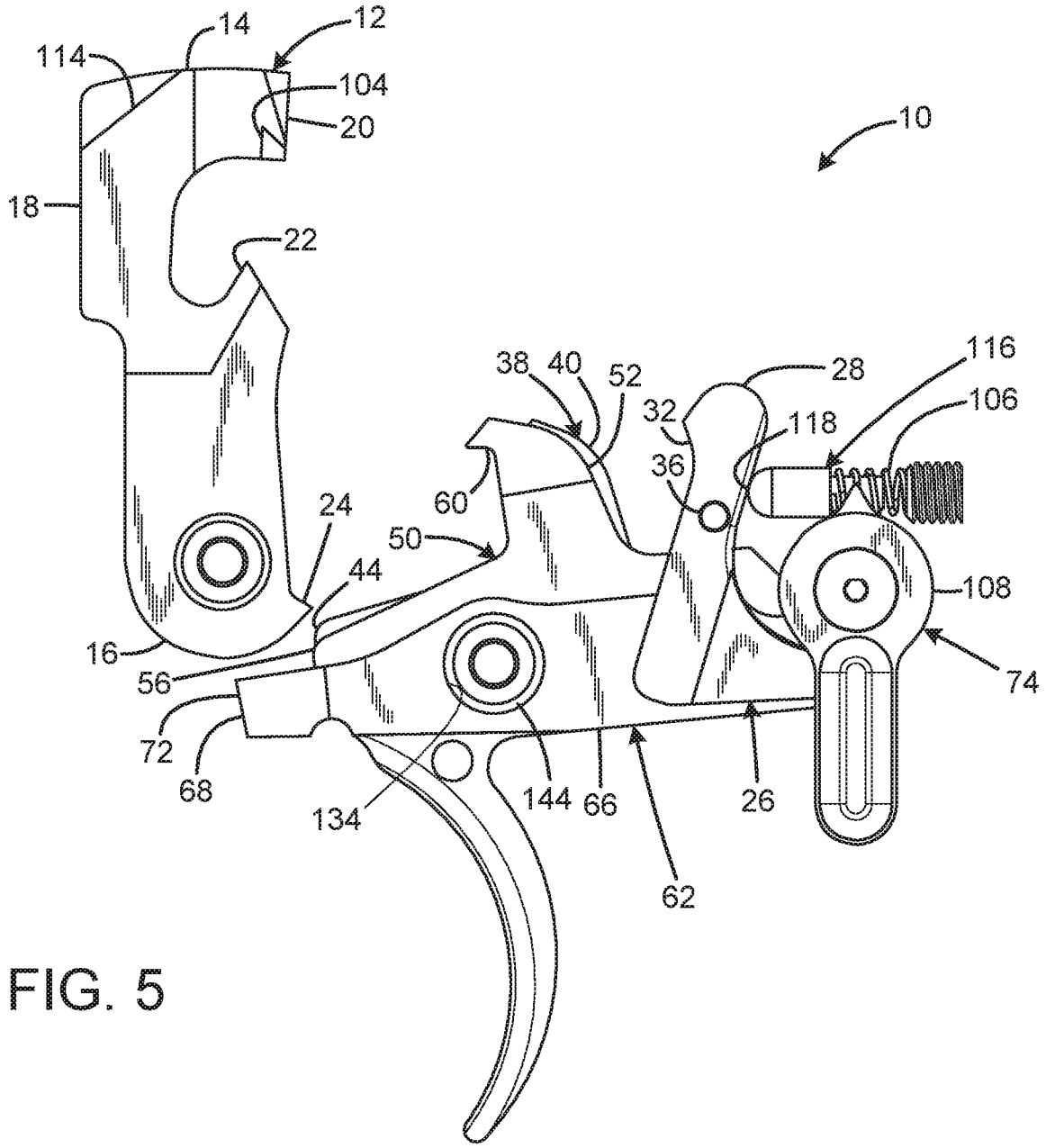
FIG. 5 is a left side view of the trigger group for semi-automatic firearms of FIG. 1 at the moment of firearm discharge with the safety selector in semi-automatic mode.

FIG. 5 illustrates the improved trigger group for semi-automatic firearms 10 of the present invention. More particularly, the trigger group for semi-automatic firearms 10 is shown in semi-automatic mode with the safety selector assembly 74 pointing at the 12 o'clock position. The trigger 62 has been pulled rearward until the trigger is stopped by the safety selector, which has disengaged the sear 72 from the notch 24 on the hammer. The disengagement has enabled the hammer 12 to rotate forward under spring pressure to hit the firing pin to discharge a round. The semi-automatic disconnector 50 is rotated counterclockwise relative to the binary disconnector 38. In this position, the hook 60 on the semi-automatic disconnector is positioned in front of the hook 48 on the binary disconnector.

Figure 6:
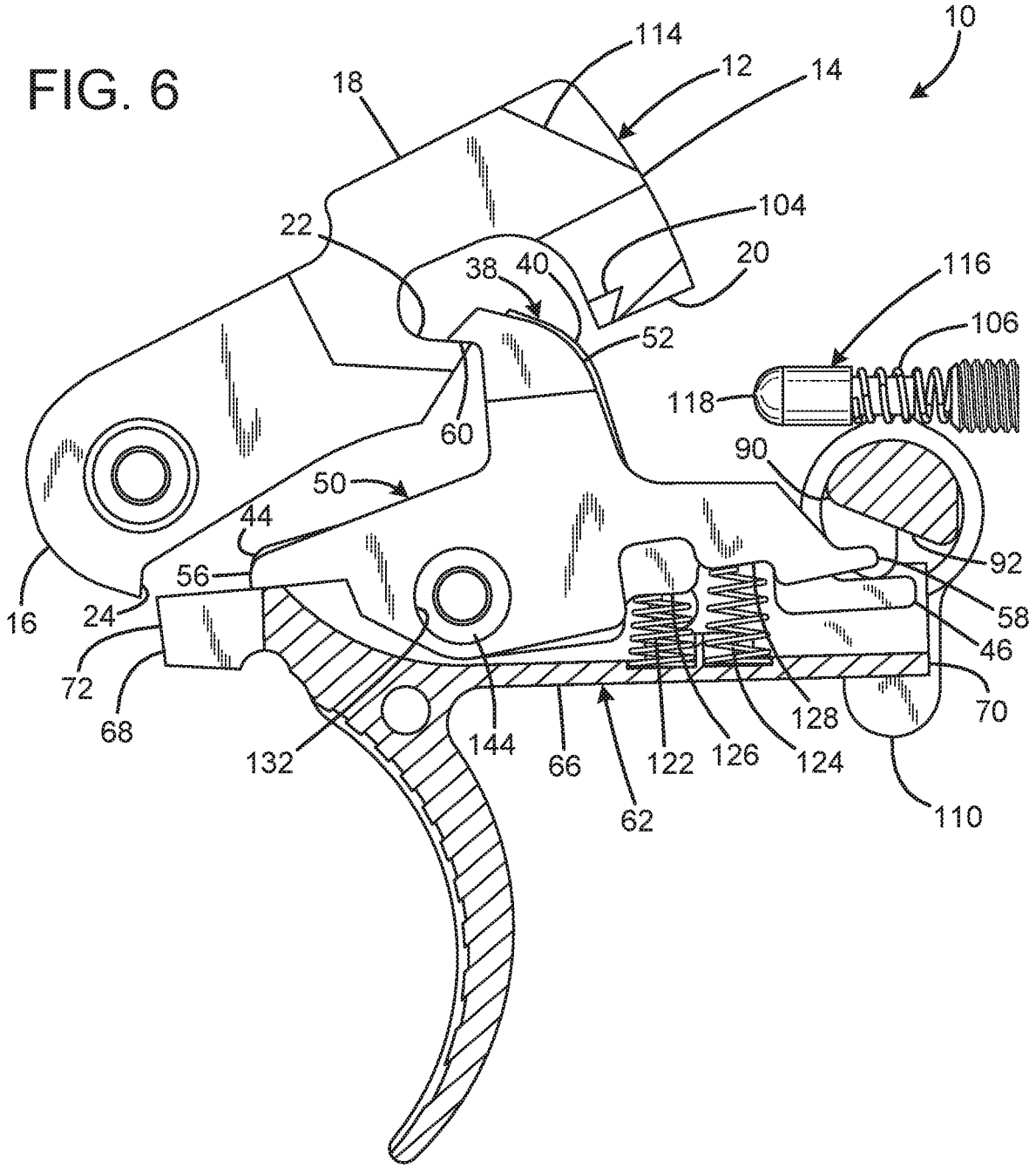
FIG. 6 is a left side sectional view of the trigger group for semi-automatic firearms of FIG. 1 after the firearm has been re-cocked with the trigger pulled when the safety selector is in semi-automatic mode.

FIG. 6 illustrates the improved trigger group for semi-automatic firearms 10 of the present invention. More particularly, the trigger group for semi-automatic firearms 10 is shown in semi-automatic mode with the safety selector assembly 74 pointing at the 12 o'clock position. Gas pressure resulting from the discharge of a round has driven the bolt carrier group 148 (shown in FIG. 8) rearward, pushing the hammer 12 back into the cocked position. The notch 22 of the hammer has latched onto the hook 60 of the semi-automatic disconnector 50. This engagement prevents the hammer from rotating forward again even though the trigger 62 remains pulled. The hook 48 on the binary disconnector 38 is held behind the hook on the semi-automatic disconnector, which prevents the hook on the binary disconnector from engaging the notch 22 on the hammer. As the trigger is released, the front 56 of the semi-automatic disconnector is pushed up. This movement disengages the notch 22 of the hammer from the hook 60 of the semi-automatic disconnector. Just prior to the hammer disengaging from the semi-automatic disconnector, the sear 72 on the trigger 62 is positioned to catch the notch 24 in the hammer, which prevents the hammer from rotating forward until the trigger is pulled again. This is the position shown in FIG. 4.

Figure 7:
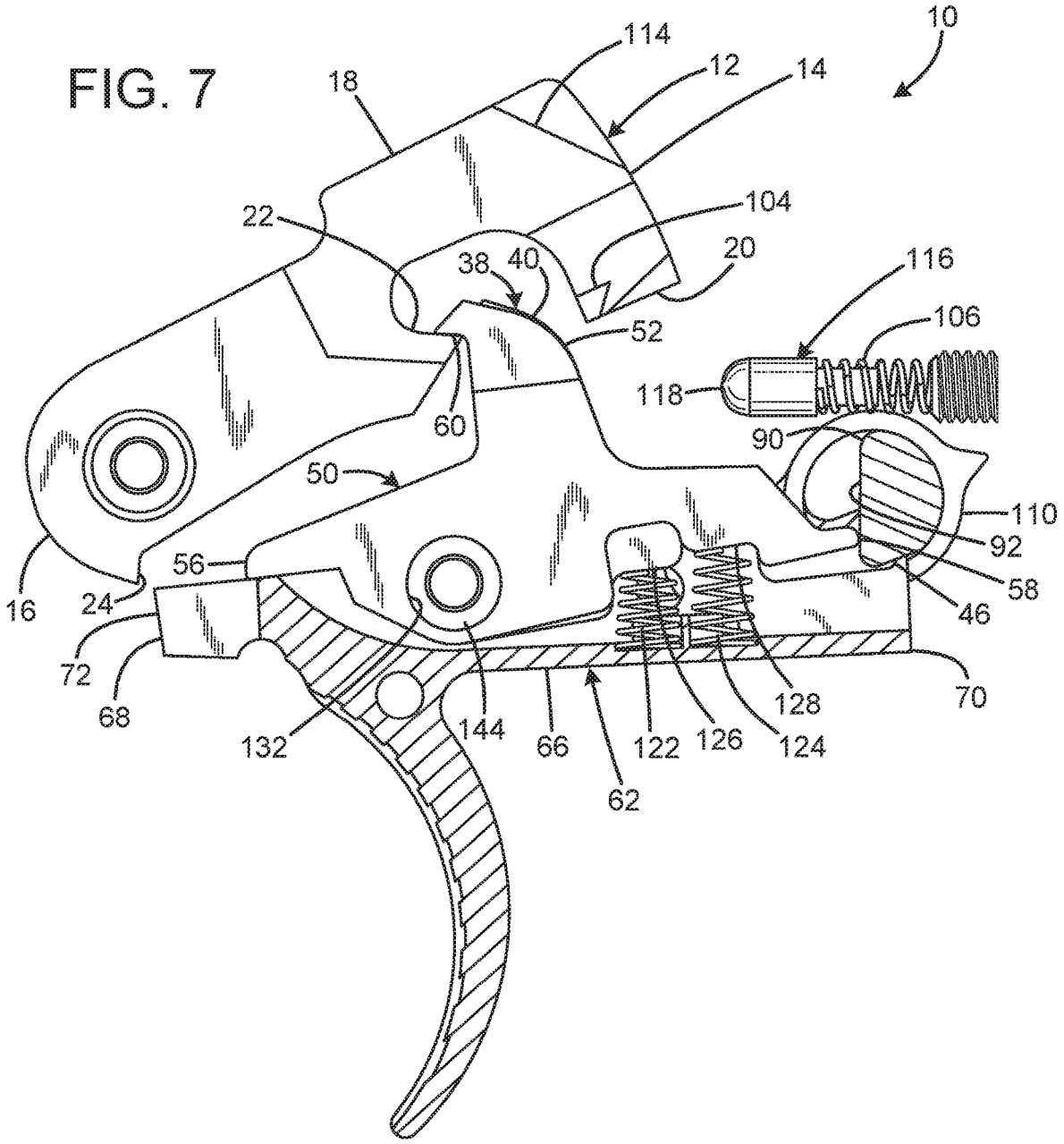
FIG. 7 is a left side sectional view of the trigger group for semi-automatic firearms of FIG. 1 with the safety selector prevented from transitioning from semi-automatic mode to binary mode when the trigger is pulled back sufficiently that otherwise an unintended shot would occur upon transition to binary mode.

FIG. 7 illustrates the improved trigger group for semi-automatic firearms 10 of the present invention. More particularly, the trigger group for semi-automatic firearms 10 is shown failing to transition from semi-automatic mode to binary mode. The safety selector assembly 74 cannot transition from semi-automatic mode to binary mode unless the trigger 62 is forward. Otherwise, the rear 58 of the semi-automatic disconnector 50 blocks cam lobe 92 on the safety selector and prevents further clockwise rotation of the safety selector into binary mode. The backup disconnector 26 is also blocked, but by the interaction between the cam pin 36 and the cam surface 146 on the housing 136 rather than by an interaction with the safety selector. This safety feature prevents users from inadvertently shifting the safety selector to binary mode unless the user clearly intends to do so. The position of the bolt carrier group 148 (shown in FIG. 8) does not affect the ability to transition from semi-automatic mode to binary mode.

In this condition, the rear 58 of the semi-automatic disconnector 50 is positioned downward in the path of the cam lobe 88 on the safety selector assembly 74. The user cannot rotate the safety selector clockwise into binary mode with the safety selector pointing at the 3 o'clock position when the trigger is pulled in semi-automatic mode.

Figure 8:
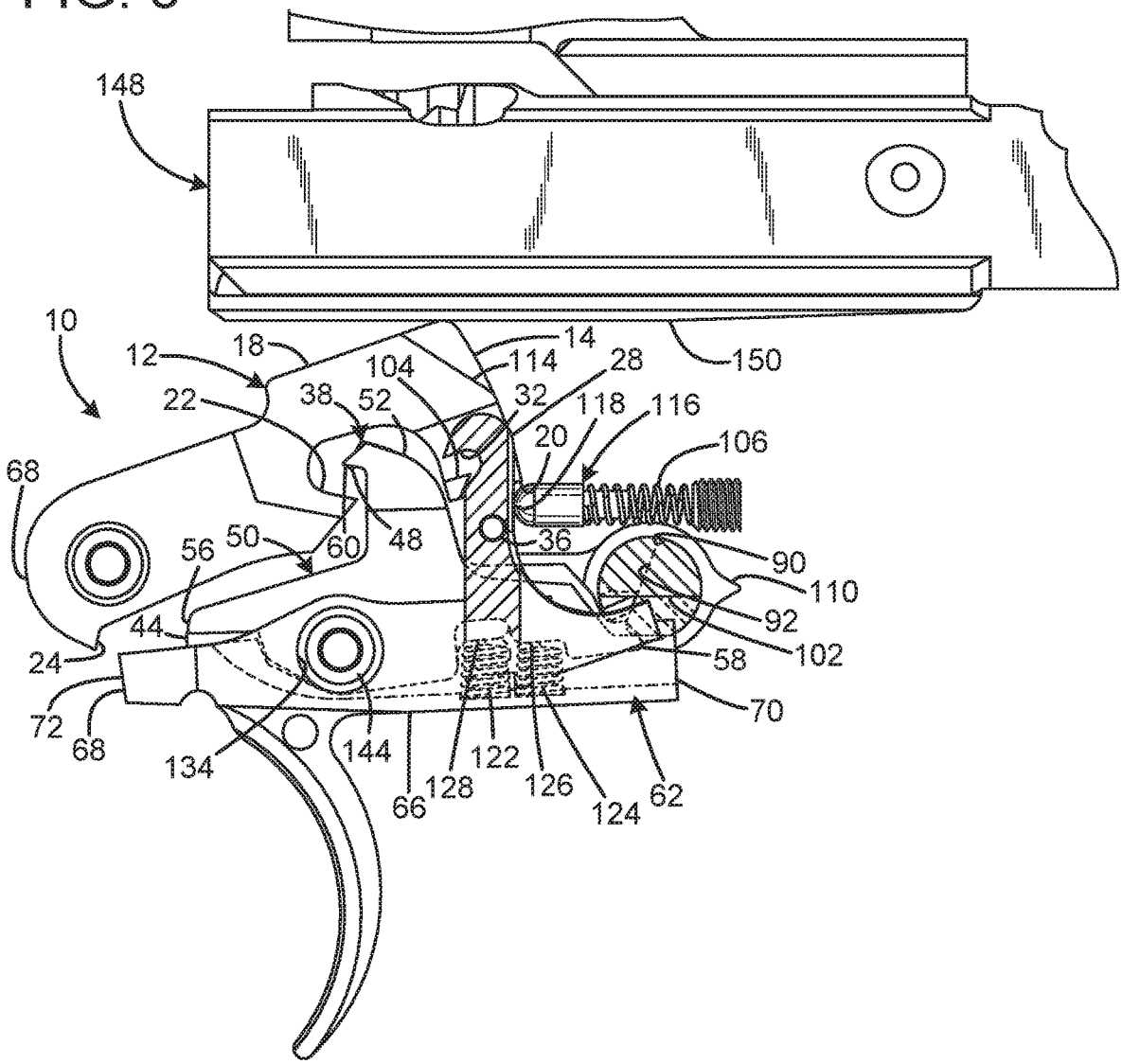
FIG. 8 is a left side sectional view of the trigger group for semi-automatic firearms of FIG. 1 with the safety selector in semi-automatic mode. The trigger has been pulled into a position such that neither the trigger sear nor the binary disconnector hook is in position to catch the hammer, and the backup disconnector is cammed into position to catch the hammer.

FIG. 8 illustrates the improved trigger group for semi-automatic firearms 10 of the present invention. More particularly, the trigger group for semi-automatic firearms 10 is shown in binary mode with the safety selector pointing at the 3 o'clock position. After a successful transition to binary mode with the trigger 62 forward, cam lobe 78 on the safety selector is recessed to allow the trigger 62 to be pulled when the hammer 12 is cocked. Cam lobe 94 on the safety selector is also recessed to allow the rear 46 of the binary disconnector 38 to rotate counterclockwise under spring pressure so the hook 48 on the binary disconnector is able to come into contact with the notch 22 on the hammer. The cam lobe 88 is pushing down on the semi-automatic disconnector 50 to prevent the rear 58 from rotating counterclockwise under spring pressure so the hook 60 on the semi-automatic disconnector is able to interface with the hammer. The hammer is restrained by the engagement of the sear 72 on the trigger with the notch 24 on the hammer. If the trigger is subsequently pulled, the hammer will rotate forward under spring pressure and hit the firing pin to discharge a round.

In FIG. 8, the trigger 62 has been previously pulled, which disengaged the sear 72 from the notch 24 on the hammer 12. The disengagement enabled the hammer to rotate forward under spring pressure to hit the firing pin to discharge a round. Gas pressure resulting from the discharge of the round has driven the bolt carrier group 148 rearward. The bottom 150 of the bolt carrier group has depressed the top 14 of the hammer into a maximum compressed state. Depression means moving the hammer beyond the cocked position, further away from the firing position.

In FIG. 8, the trigger 62 is positioned so neither the sear 72 on the trigger nor the hook 48 on the binary disconnector 40 can catch the hammer 12 when the hammer falls forward after the bolt carrier group 148 releases the hammer when the bolt carrier group travels forward. The inability of the sear 72 and the binary disconnector 38 to catch the hammer 12 after the bolt carrier group 148 releases the hammer is a rare occurrence during normal operation of the trigger group for semi-automatic firearms 10. However, it is essential for safety to prevent the hammer from falling forward unintentionally to strike the firing pin. To ensure the hammer cannot fall forward unintentionally to strike the firing pin, the backup disconnector 26 is located by the interaction between the cam pin 36 and the cam slot 146 in the housing 136 to a front uppermost position when the trigger assumes the position shown in FIG. 8. When the backup disconnector is located in the position illustrated in FIG. 8, the bolt carrier group depresses the hammer sufficiently for the front hook 32 on the backup disconnector to hook onto the ridge 104 on the hammer 12 to restrain the hammer.

If the trigger 62 is at rest in the forward position, then the sear 72 on the trigger 72 will catch the hammer 12 when the bolt carrier group 148 releases the hammer. If the trigger is pulled back more than the position shown in FIG. 8 when the bolt carrier group 148 depresses the hammer 12 during binary mode operation, the trigger group for semi-automatic firearms 10 skips the positions shown in FIGS. 8-10 where the backup disconnector 26 hooks onto the ridge 104 on the hammer 12 to restrain the hammer. This occurs because the backup disconnector is not in the front uppermost position and cannot engage the hammer. Instead, when the trigger group for semi-automatic firearms is operated in binary mode with the trigger pulled rearward of the position shown in FIG. 8, the trigger group for semi-automatic firearms proceeds directly to the position shown in FIG. 11 where the hook 48 on the binary disconnector 38 catches the hammer after the bolt carrier group 148 releases the hammer.

Figure 9:
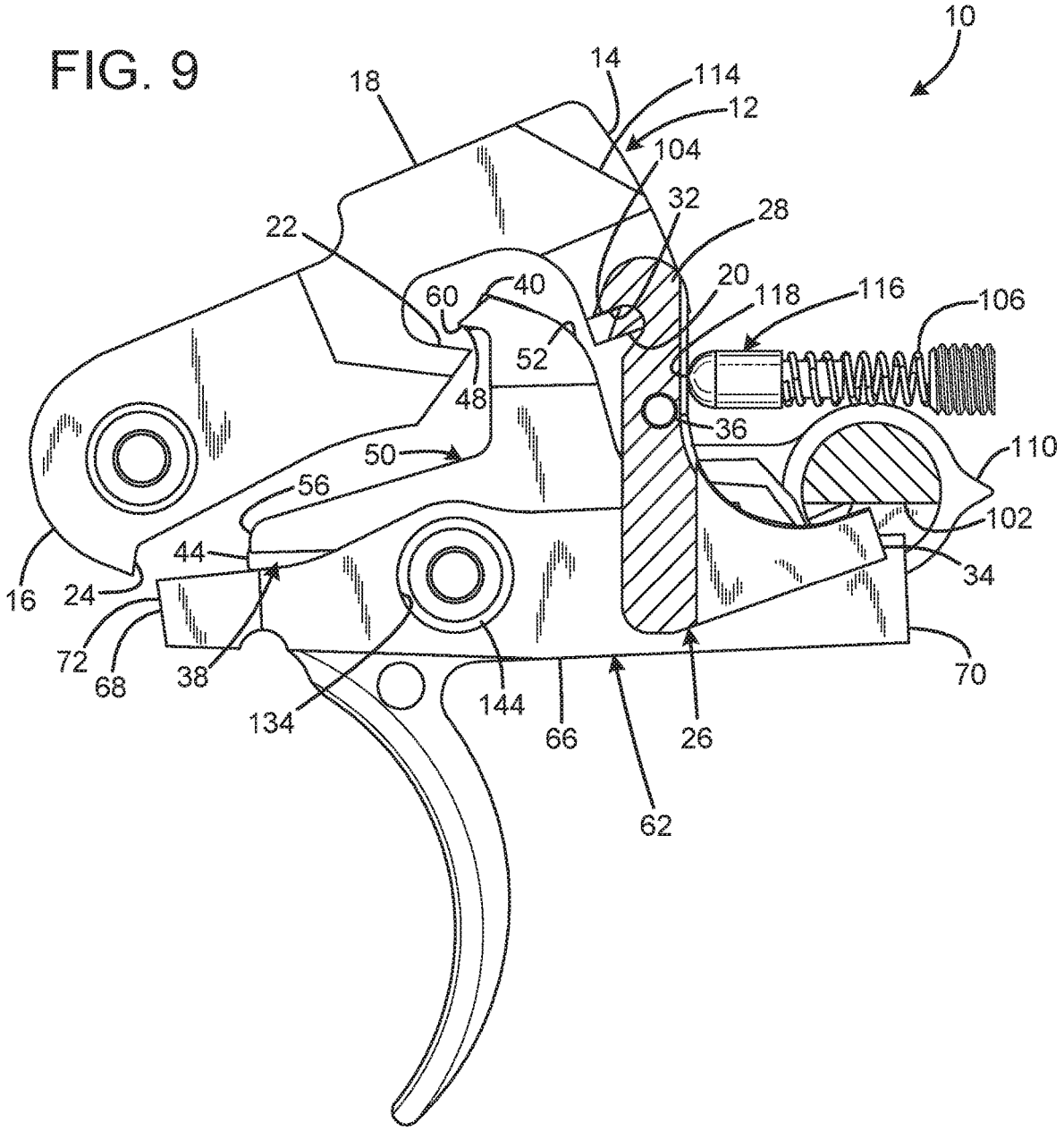
FIG. 9 is a left side sectional view of the trigger group for semi-automatic firearms of FIG. 1 with the hammer held by the backup disconnector and the trigger at rest when the safety selector is in binary mode.

FIG. 9 illustrates the improved trigger group for semi-automatic firearms 10 of the present invention. More particularly, the trigger group for semi-automatic firearms 10 is shown in binary mode with the safety selector assembly 74 pointing at the 3 o'clock position. The bolt carrier group 148 has traveled forward relative to the position shown in FIG. 8 thus allowing the front hook 32 of the backup disconnector 26 to grasp the ridge 104 on the hammer 12, thereby preventing counterclockwise rotation of the hammer. The trigger 62 is shown at rest in the forward position.

Figure 10:
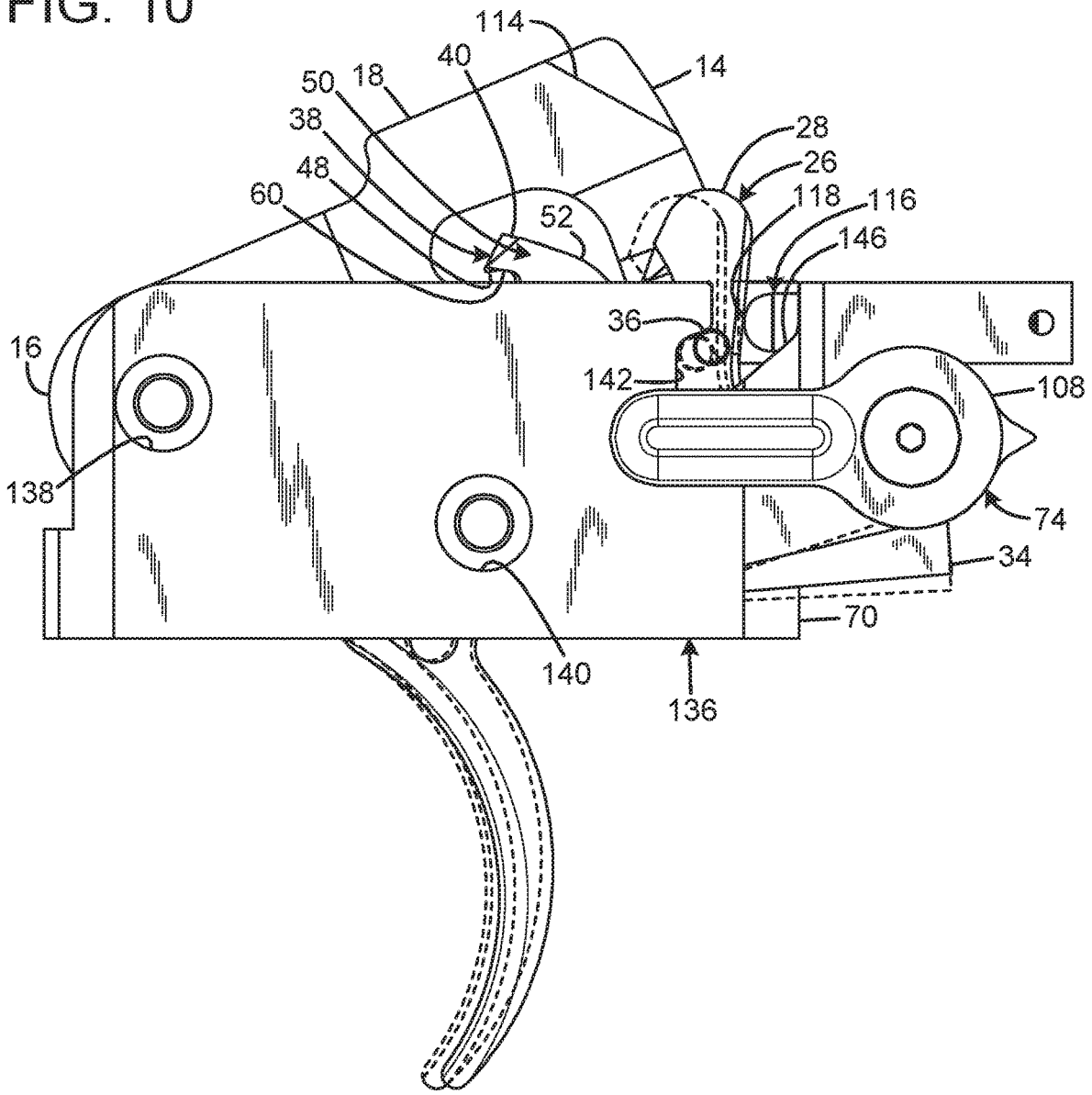
FIG. 10 is a left side view of the trigger group for semi-automatic firearms of FIG. 1 with the safety selector in binary mode and the trigger pulled to the moment the backup disconnector releases the hammer.

FIG. 10 illustrates the improved trigger group for semi-automatic firearms 10 of the present invention. More particularly, the trigger group for semi-automatic firearms 10 is shown in binary mode with the safety selector assembly 74 pointing at the 3 o'clock position. In this condition where the backup disconnector 26 restrains the hammer 12, cam lobe 78 on the safety selector assembly 74 is recessed to allow the trigger 62 to be pulled when the hammer 12 is cocked. As the user pulls the trigger 62 rearward in this condition, the cam pin 36 on the backup disconnector 26 cams on the cam surface 146 on the housing 136, thereby pushing the backup disconnector upward and rearward simultaneously. Once the trigger is pulled sufficiently rearward, the front hook 32 on the backup disconnector disengages from the ridge 104 on the hammer 12 and releases the hammer.

Figure 11:
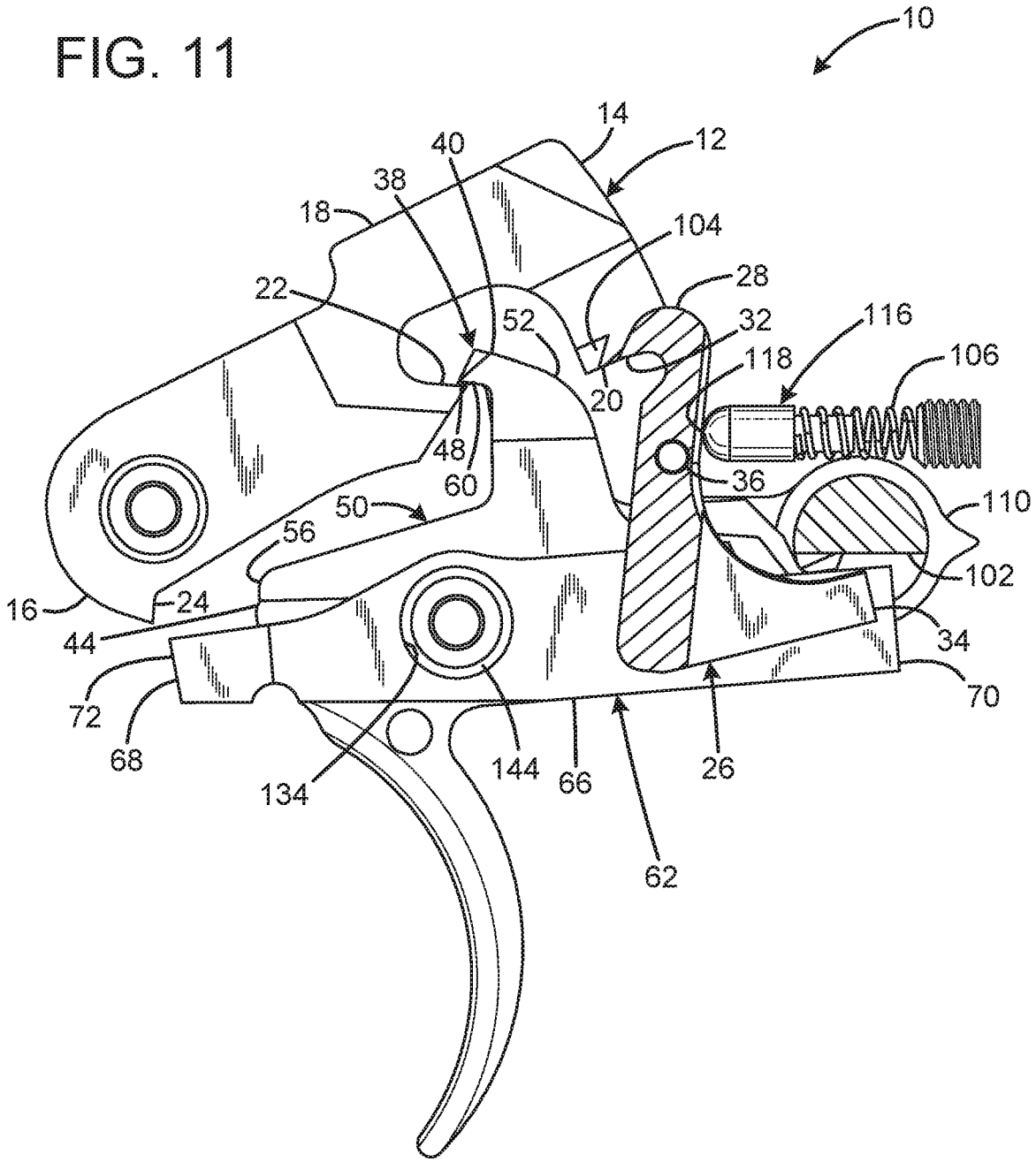
FIG. 11 is a left side sectional view of the trigger group for semi-automatic firearms of FIG. 1 with the safety selector in binary mode and the trigger pulled sufficiently that the hammer is caught by the binary disconnector.

FIG. 11 illustrates the improved trigger group for semi-automatic firearms 10 of the present invention. More particularly, the trigger group for semi-automatic firearms 10 is shown in binary mode with the safety selector assembly 74 pointing at the 3 o'clock position. Before the hammer 12 can travel all the way to the firing pin after being released by the backup disconnector 26 in the circumstances shown in FIGS. 8-10, or after being released by the forward movement of the bolt carrier group 148 in the more commonly occurring trigger 62 positions during binary mode operation, the hook 48 on the binary disconnector engages with the notch 22 on the hammer. This engagement prevents the hammer from rotating forward again even though the trigger 62 remains pulled. The hook 60 on the semi-automatic disconnector 50 is held behind the hook on the binary disconnector, which prevents the hook on the semi-automatic disconnector from engaging the notch 22 on the hammer. As the trigger is released, the front 44 of the binary disconnector is pushed up. This movement disengages the notch 22 of the hammer from the hook 48 of the binary disconnector. Unlike semi-automatic mode, the sear 72 on the trigger 62 is not positioned to catch the notch 24 in the hammer 12 just prior to the hammer disengaging from the binary disconnector 38. As a result, the hammer rotates forward again upon release of the trigger, discharging a second round.

Figure 12:
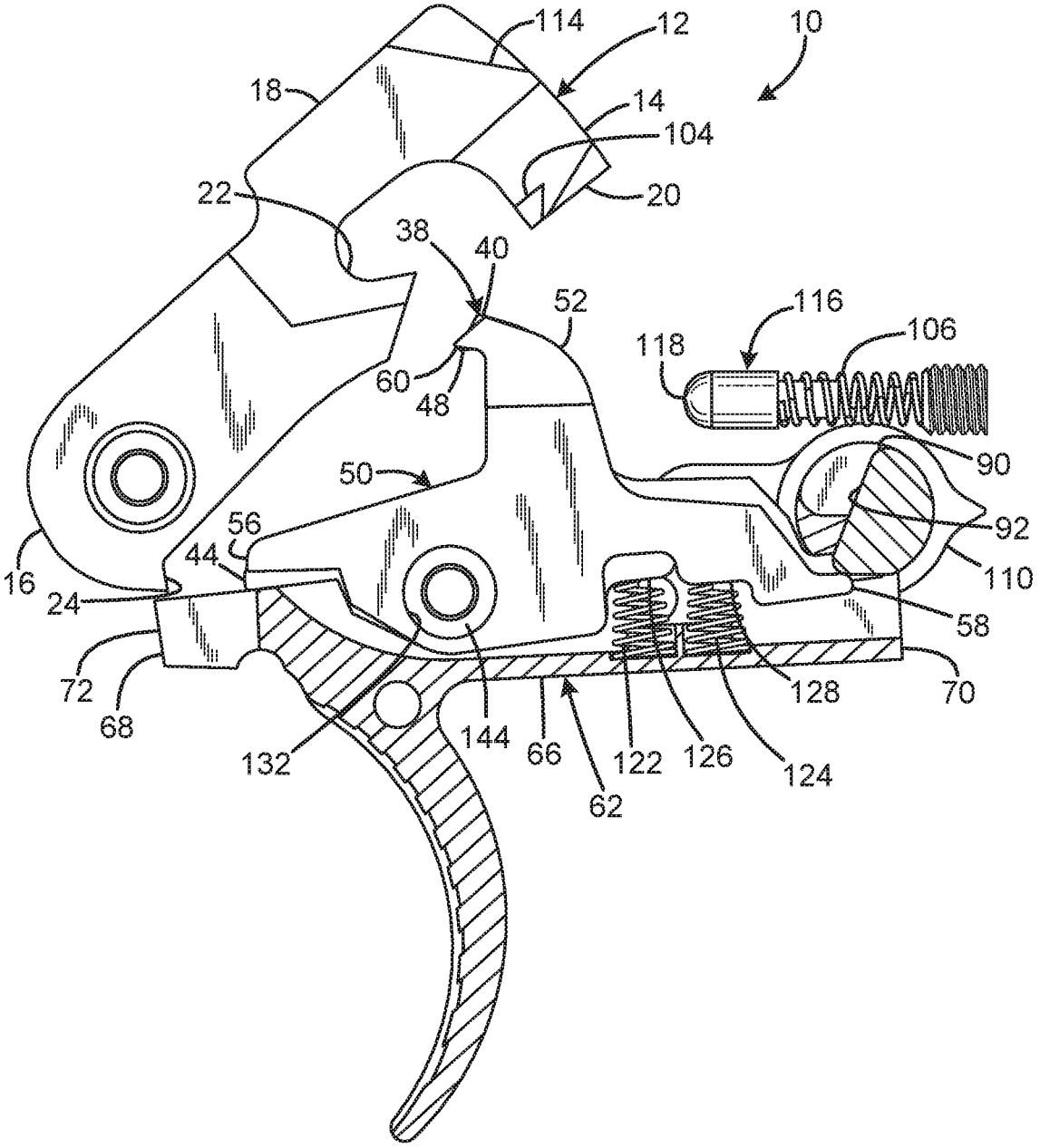
FIG. 12 is a left side sectional view of the trigger group for semi-automatic firearms of FIG. 1 with the safety selector in binary mode and the trigger relaxed sufficiently to disengage the hammer from the binary disconnector.

FIG. 12 illustrates the improved trigger group for semi-automatic firearms 10 of the present invention. More particularly, the trigger group for semi-automatic firearms 10 is shown in binary mode with the safety selector assembly 74 pointing at the 3 o'clock position. The cam lobe 88 pushes the rear 58 of the semi-automatic disconnector 50 downwards so the hook 60 on the semi-automatic disconnector is pulled rearward and is unable to interface with the hammer.

In FIG. 12, the user has relaxed the trigger 62 sufficiently that the hook 48 of the binary disconnector 38 has released the hammer 12. The hammer is then free to swing unimpeded to the firing pin to discharge a round because the sear 72 on the trigger is not far enough forward to engage the notch 24 on the hammer, and the hook 60 on the semi-automatic disconnector 50 cannot reach the notch 22 on the hammer.

Figure 13:
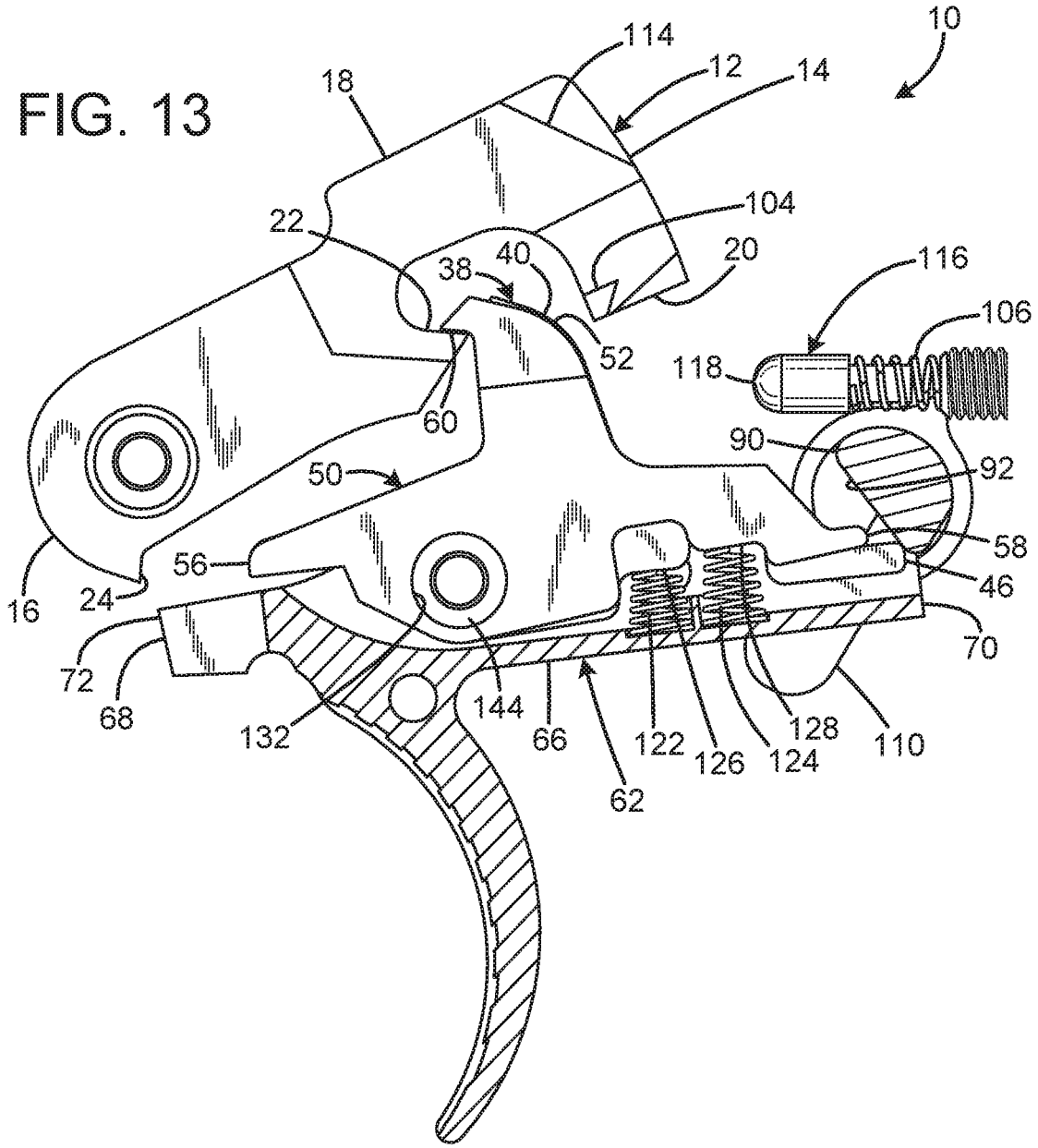
FIG. 13 is a left side sectional view of the trigger group for semi-automatic firearms of FIG. 1 with the safety selector in transition from binary mode to semi-automatic mode to cancel the release shot.
Figure 14:
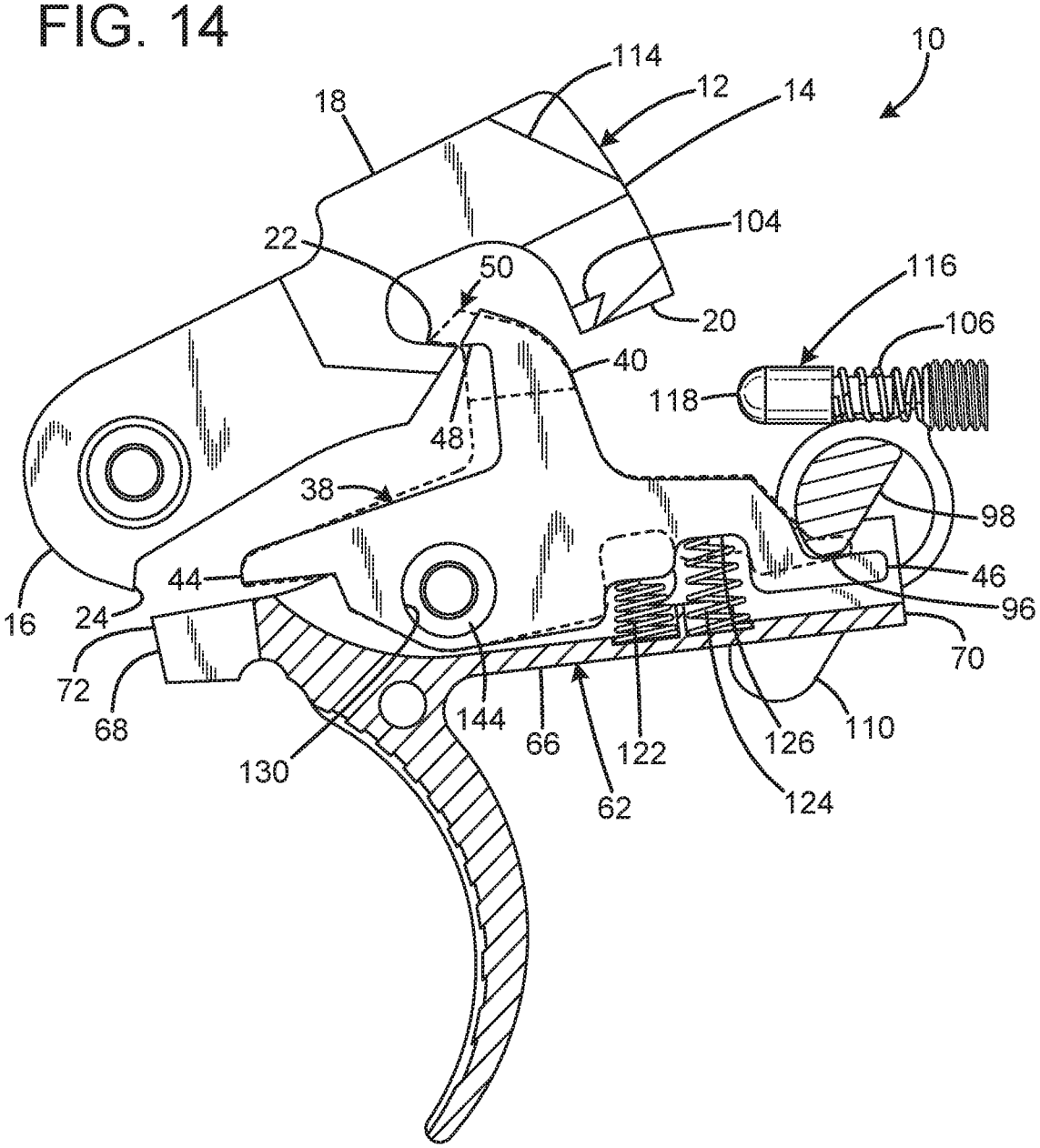
FIG. 14 is a left side sectional view of the trigger group for semi-automatic firearms of FIG. 1 with the safety selector in transition from binary mode to semi-automatic mode to cancel the release shot.

FIGS. 13 and 14 illustrate the improved trigger group for semi-automatic firearms 10 of the present invention. More particularly, the trigger group for semi-automatic firearms 10 is shown transitioning from binary mode to semi-automatic mode with the safety selector assembly 74 pointing at the 1:30 position. The user has the ability to transition from binary mode to semi-automatic mode even after having pulled the trigger 62 in binary mode. This is an important safety feature because it enables the user to cancel the firing of a release shot in binary mode instead of requiring the user to first fire a release shot in binary mode if the trigger has been pulled before transitioning from binary mode to semi-automatic mode. If desired, the user can continue to rotate the safety selector counterclockwise to return the firearm to safe mode. This can be accomplished even if the firearm is initially in binary mode with the trigger held back waiting to fire a round upon trigger release. The user can manipulate the selector to return the firearm to safe mode while holding the trigger back without discharging the round. This is an incredibly important capability since persons utilizing deadly force must generally cease fire when a threat has been eliminated. To fire a round in such an instance would be a significant liability for the owner of the firearm.

When the user rotates the safety selector assembly 74 to transition from binary mode to semi-automatic mode with the trigger 62 pulled, the cam lobe 88 is positioned relative to the cam lobe 94 so the semi-automatic disconnector can rotate forward into position so the hook 60 engages the notch 22 on the hammer before the cam lobe 94 rotates the binary disconnector 38 backwards so the hook 48 disengages from the notch 22 on the hammer. Once the safety selector points to the 12 o'clock position, the trigger group for semi-automatic firearms has returned to the position shown in FIG. 6.

As is shown in FIG. 1, the binary disconnector 38 and the semi-automatic disconnector 50 differ in subtle ways. First, the binary disconnector has a reversed bottom 42 rear 46 profile relative to the semi-automatic disconnector 50. Second, the bottom 42 front 44 of the binary disconnector is positioned slightly higher than the bottom 54 front 56 of the semi-automatic disconnector. Third, the forward facing hook 60 of the semi-automatic disconnector extends slightly forward of the forward facing hook 48 of the binary disconnector. A binary disconnector spring 122 has one end received within a notch 126 in the bottom rear of the binary disconnector. A semi-automatic disconnector spring 124 has one end received within a notch 128 in the bottom rear of the semi-automatic disconnector. The springs cause the disconnectors to be biased to rotate counterclockwise about a pin (not labeled) inserted through aperture 130 in the binary disconnector and aperture 132 in the semi-automatic disconnector.

While the semi-automatic disconnector 50 and the binary disconnector 38 differ in seemingly minor ways, these slight changes in geometry affect what gun designers refer to as the "timing" of the trigger group 10. These changes in geometry are normally used to provide the proper function for a conventional semi-automatic rifle (especially to prevent it from being readily modified) or for full-automatic or select fire machine guns.

Because of the geometry, the semi-automatic disconnector 50 operates to catch the hammer 12 as the hammer is pushed back by the bolt after firing, even while the trigger 62 is still pulled back from a shot. When the trigger is released, the geometry of the semi-automatic disconnector provides that the trigger sear 72 is elevated adequately by the time the hammer swings forward slightly, so the hammer sear surface 24 catches on the sear, readying the trigger for firing.

When the binary disconnector 38 is enabled (which occurs in the same manner as enabling the semi-automatic disconnector 50 by the safety selector assembly 74 shifting the binary disconnector forward so the binary disconnector's forward facing hook 48 can engage the hammer 12) the slightly different timing geometry gives a different result when the trigger 62 is released. Instead of releasing the hammer to the sear 72, the different geometry allows the hammer sear surface 24 to bypass the sear, and the hammer to fly forward to fire a shot. The bolt cocks back the hammer, where the binary disconnector catches the hammer while the trigger remains pulled back under most circumstances, and the backup disconnector catches the hammer when the trigger is pulled back into a specific position where neither the trigger sear nor the binary disconnector can catch the hammer.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a trigger group for semi-automatic firearms has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, although an AR-15 is disclosed, the invention is suitable for use with a wide variety of firearm platforms including the M-16 and AR-10.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A trigger assembly for a firearm comprising:

a frame;

a hammer connected to the frame and movable between a cocked position and a striking position;

the hammer being biased toward the striking position;

a trigger element connected to the frame and movable by a user between a forward position and a rearward position;

a selector consisting of a single piece connected to the frame and movable between at least a first position and a second position; and a plurality of retention facilities each operable to selectively restrain the hammer in the cocked position, and when the selector is in the first position to enable discharge of the firearm in response to movement of the trigger to the rearward position and to maintain the firearm without discharging upon release of the trigger to the forward position, and when the selector is in the second position to enable discharge of the firearm in response to movement of the trigger to the rearward position and to enable an additional discharge of the firearm upon release of the trigger to the forward position; and the frame including a cam surface operably engaged by at least one of the retention facilities.

* * * * *